US009464771B1

(12) United States Patent
Anderson

(10) Patent No.: US 9,464,771 B1
(45) Date of Patent: Oct. 11, 2016

(54) LIGHT BAR ASSEMBLY FOR ILLUMINATING AN EDGE OF A PIECE OF MATERIAL

(71) Applicant: Kenneth E. Anderson, Kearney, NE (US)

(72) Inventor: Kenneth E. Anderson, Kearney, NE (US)

( * ) Notice: Subject to any disclaimer, the term of this patent is extended or adjusted under 35 U.S.C. 154(b) by 195 days.

(21) Appl. No.: 14/568,784

(22) Filed: Dec. 12, 2014

(51) Int. Cl.

| | |
|---|---|
| ***A47B 23/06*** | (2006.01) |
| ***A47B 97/00*** | (2006.01) |
| ***F21V 33/00*** | (2006.01) |
| ***F21S 4/00*** | (2016.01) |
| ***F21V 21/00*** | (2006.01) |

(52) U.S. Cl.
CPC ..... *F21S 4/008* (2013.01); *F21V 21/00* (2013.01); *F21V 33/0012* (2013.01)

(58) Field of Classification Search
CPC ..... F21S 4/008; F21S 8/00; F21V 33/0012; F21V 21/00; F21V 33/00; F21W 2131/301; F21K 9/10; F21K 9/13; F21K 9/17; F21K 9/175; F21K 9/30
USPC ..... 362/127, 133, 217.1, 217.14, 217.16, 362/97.1, 97.2, 97.3, 249.01, 249.02
See application file for complete search history.

(56) References Cited

U.S. PATENT DOCUMENTS 8,277,070 B1 * 10/2012 Schwarz ..... E03C 1/33 312/140.1
2016/0109103 A1 * 4/2016 Yang ..... F21V 19/0045 362/382

* cited by examiner

*Primary Examiner* — Anh Mai
*Assistant Examiner* — Glenn Zimmerman
(74) *Attorney, Agent, or Firm* — Dennis L. Thomte; Thomte Patent Law Office LLC

(57) ABSTRACT

A light bar assembly is disclosed which is configured to be placed adjacent at least one edge of a glass member such as a countertop, backsplash, or mirror. The light bar assembly includes a first support member having a second support member selectively secured thereto. An LED light strip is positioned in the lower support member so as to direct light into the glass member. If the light strip fails, the upper support member may be detached from the lower support member to provide ready access to the light strip for repair or replacement.

5 Claims, 10 Drawing Sheets

LIGHT BAR ASSEMBLY FOR ILLUMINATING AN EDGE OF A PIECE OF MATERIAL

BACKGROUND OF THE INVENTION

1. Field of the Invention

This invention relates to a light bar assembly for illuminated an edge of a piece of material. More particularly, this invention relates to an LED light bar or light bars for illuminating a horizontally disposed glass countertop, a vertically disposed glass backsplash or a member requiring illumination. Even more particularly, this invention relates to a light bar assembly of the type described which includes a housing which is easily and conveniently accessible for repair or replacement should the LED's or the components thereof fail.

2. Description of the Related Art

Countertops for cabinets, etc. in recent years have been comprised of Corian™, granite, stone, etc. Lately, there has been a tremendous interest in manufacturing the countertops from a glass material, usually recycled glass. Further, lighting devices such as LEDs have been provided to illuminate the countertops. However, should the lighting devices fail, it is extremely difficult to repair or replace the lighting devices and associated components without disturbing the glass countertop.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A light bar assembly is disclosed for illuminating a horizontally disposed glass countertop, a vertically disposed glass backsplash, or other piece of material. One or more of the light bars of this invention may be utilized with the edges of the glass countertop, the glass backsplash, or other piece of material.

In one embodiment, a horizontally disposed glass countertop is positioned on the upper end of a supporting structure such as a cabinet, sink or the like with the glass countertop having an upper surface, a lower surface, a first end edge, a second end edge, a first side edge and a second side edge. The light bar of this invention is elongated and has first and second ends. The light bar assembly is positioned adjacent to one of the end or side edges of the countertop. The light bar assembly of this invention includes an elongated and horizontally extending lower support member having first and second ends. The light bar assembly of this invention also includes an elongated and horizontally extending upper support member which is selectively removably secured to the lower support member. The lower support member has a horizontally disposed lower wall with inner and outer ends, an upstanding wall, having an inner side, an outer side, an upper end, and a lower end, which extends upwardly from the outer end of the lower wall thereof. A vertically disposed slot extends downwardly into the upstanding wall of the lower support member from the upper end thereof. An elongated LED light strip is secured to the inner side of the upstanding wall of the lower support member. The LED light strip is selectively electrically connected to a source of electrical power. The upper support member includes a generally horizontally disposed upper wall, having inner and outer ends, a vertically disposed wall, having upper and lower ends which extends downwardly from the upper wall of the upper support member adjacent the outer end of the upper wall of the upper support member. The vertically disposed wall of the upper support member is selectively received in the slot in the upstanding wall of the lower support member to attach the upper support member to the lower support member.

The inner end of the lower wall of the lower support member is positioned adjacent one edge of the countertop. The inner end of the upper wall of the upper support member is positioned at the upper surface of the countertop adjacent at one edge thereof whereby light from the LED light strip will be directed into the countertop. In the preferred embodiment, a light bar assembly is positioned adjacent at a plurality of the edges of the countertop.

The light bar assembly of this invention may also be used with a vertically disposed backsplash or a mirror.

Therefore a principal object of the invention is to provide an improved light bar for use with either a horizontally disposed glass countertop, a vertically disposed glass backsplash or another piece of material.

A further object of the invention is to provide a light bar for use with either a vertically disposed glass countertop, a vertically disposed glass backsplash or another piece of material wherein the light bar includes a first support member having a second support member selectively removably secured thereto to provide ready access to the interior of the light bar assembly should the LED light strip or components associated therewith need repair or replacement.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
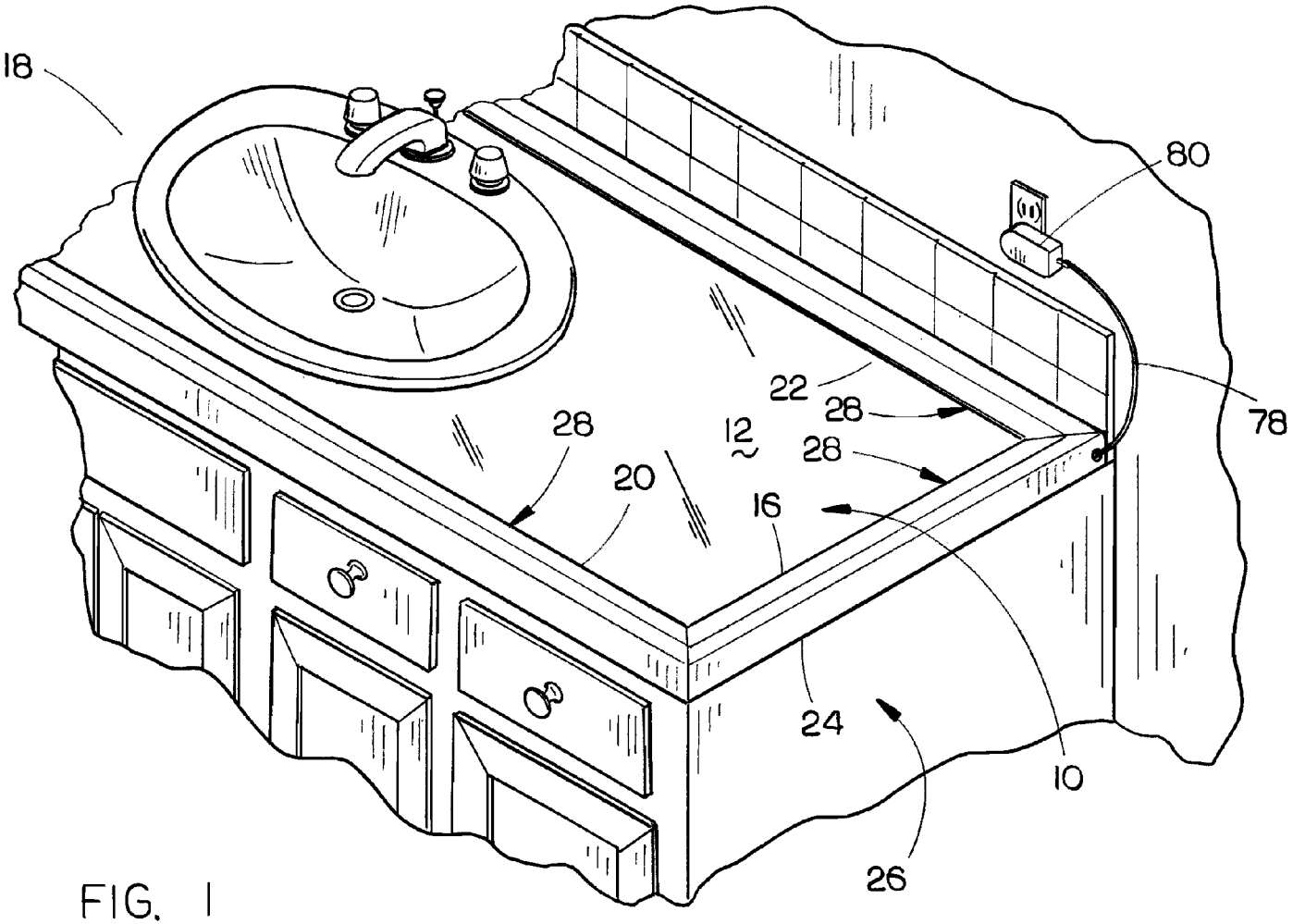
FIG. 1 is a partial perspective view illustrating the light bars of this invention being positioned adjacent some of the edges of a glass countertop to illuminate the same.
Figure 2:
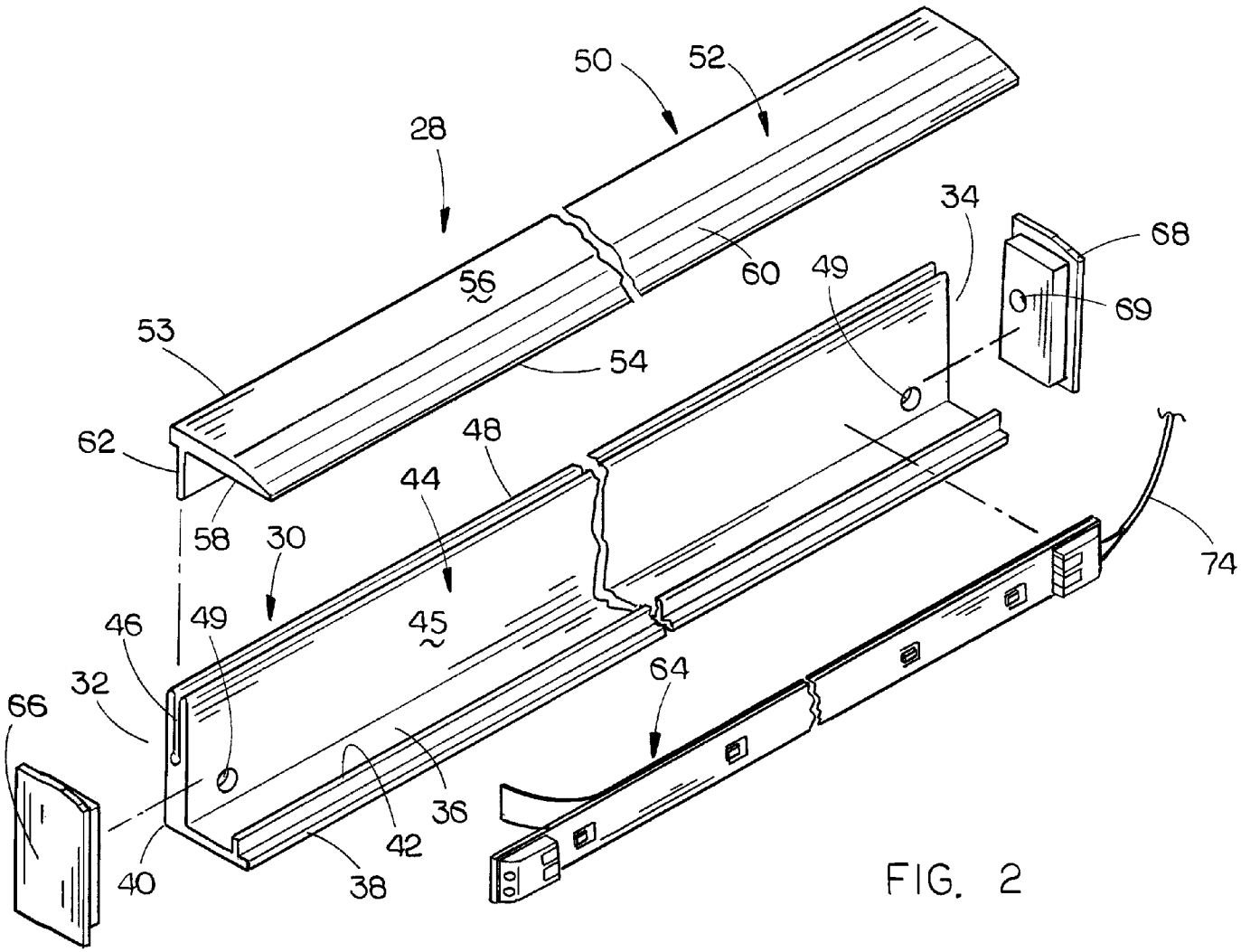
FIG. 2 is a partial exploded perspective view of a first embodiment of the light bar of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a glass countertop having an upper surface 12, a lower surface 14, end edges 16 and 18, and side edges 20 and 22. The thickness of the countertop 10 will vary somewhat. Glass is the preferred composition of the countertop 10 but other materials could be utilized as long as the material permits the passage of light therethrough. Countertop 10 will normally be installed on the upper end 24 of a cabinet such as a bathroom cabinet 26 or a kitchen cabinet.

The numeral 28 refers to the elongated light bar of this invention which may be positioned on the upper end 24 of cabinet 26 adjacent to one or more of the end and side edges of the countertop 10, as seen in FIG. 1. Light bar 28 includes an elongated lower support member 30, having ends 32 and 34. Support member 30 includes a horizontally disposed lower wall 36 having an inner end 38 and an outer end 40. It is preferred that a lip 42 be provided which extends upwardly from lower wall 36 although the lip 42 may not be included in all installations.

Lower support member 30 also includes an upstanding outer wall 44 which extends upwardly from the outer end 40 of lower wall 36 at a right angle with respect thereto. The outer wall 44 will be described as having an inner side 45. Outer wall 44 has a vertically disposed slot 46 formed therein which extends downwardly thereinto from the upper end 48 thereof. Outer wall 44 has one or more openings 49 formed therein to permit electrical wires to be extended therethrough.

Light bar 28 also includes a horizontally disposed upper support member 50 which has an upper wall 52 with an inner end 53, an outer end 54, an upper surface 56 and a lower surface 58. Preferably, the upper surface of the inner end 53 has a downwardly and inwardly extending portion 60 formed therein. Upper support member 50 includes a vertically disposed wall 62 which extends downwardly from upper wall 52 inwardly of outer end 54. As will be described hereinafter, wall 62 is designed to be received in slot 46 of outer wall 44 of lower support member 30. It is preferred that the inner end 53 of upper wall 50 be disposed inwardly of inner end 38 of lower wall member 36 when the upper support member 50 is secured to lower support member 30.

The numeral 64 refers to an elongated LED light strip or tape which is secured to the inner side 45 of wall 44 of lower support member 30. One end of light strip or tape 64 is electrically connected to a source of electrical power which is normally a 15-volt power source but could be a 12-24 volt power source. The ends of light bar 28 are closed by caps 66 and 68, one of which may have an opening 69 formed therein to permit electrical wires to extend therethrough.

Figure 4:
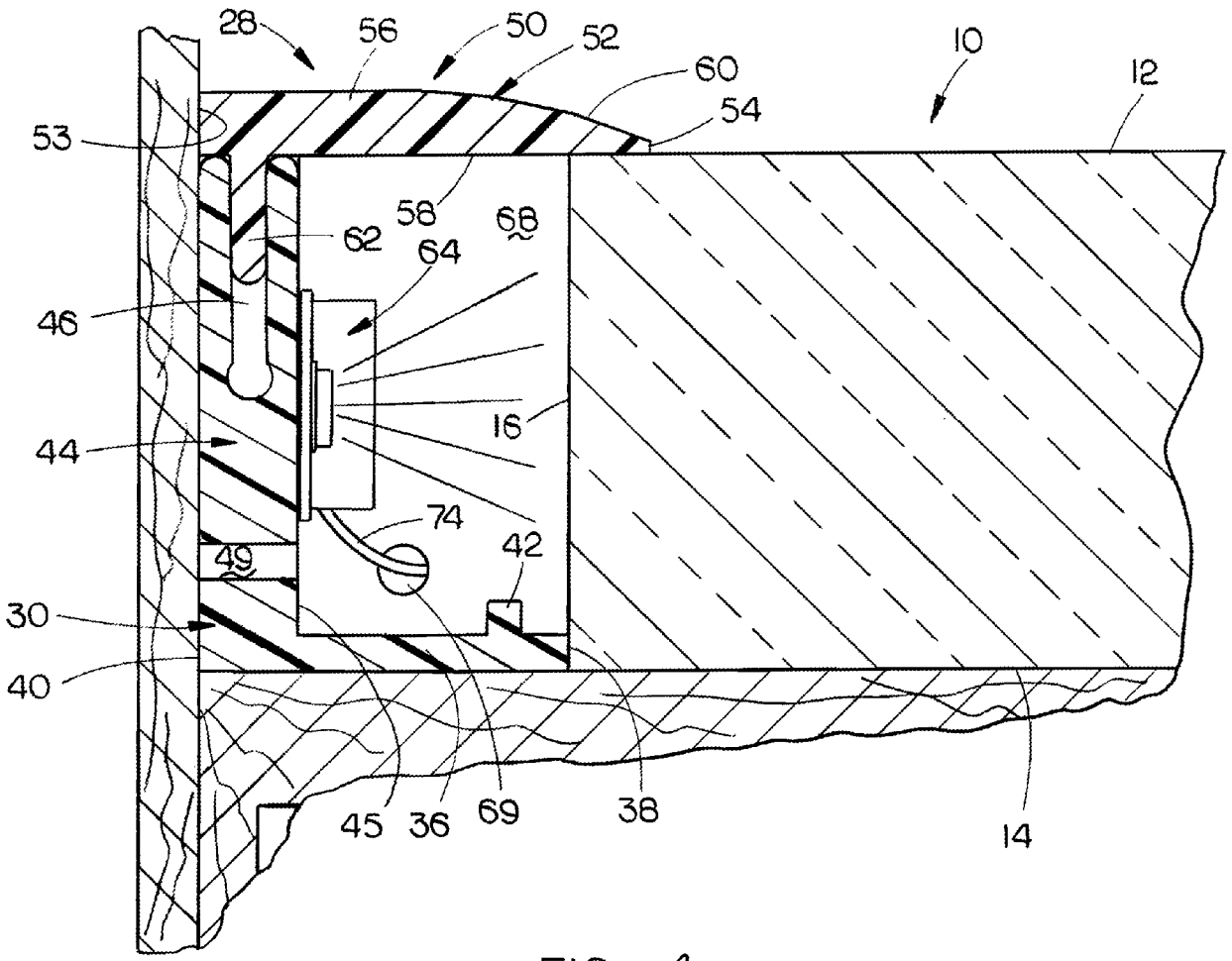
FIG. 4 is a partial sectional view of the first embodiment of the light bar of this invention positioned adjacent one edge of a glass countertop.
Figure 5:
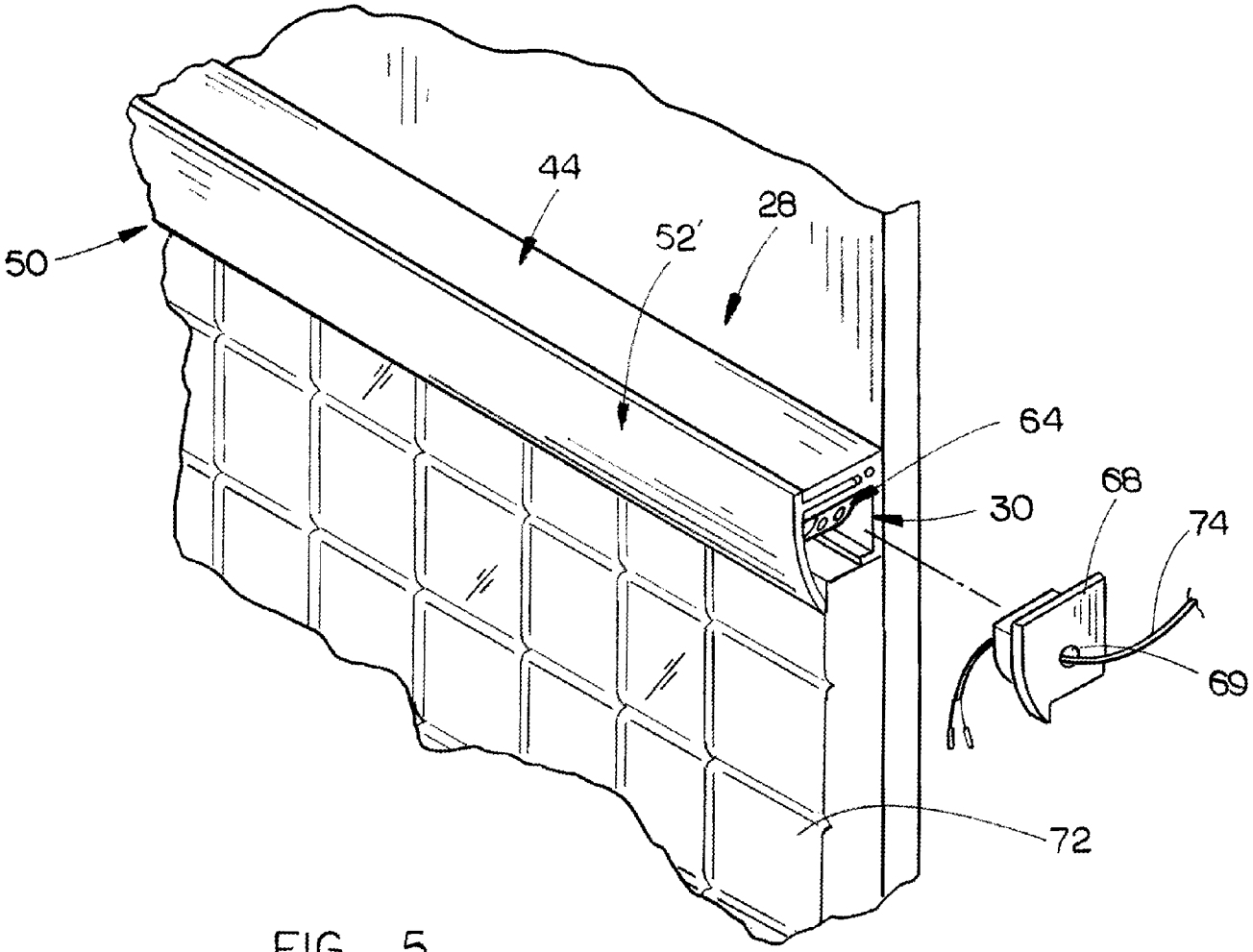
FIG. 5 is a partial exploded perspective view of a second embodiment of the light bar of this invention.

The light bar 28 is installed as will now be described. In one scenario, the countertop is first positioned on a supporting surface and secured thereto. In another scenario, the lower support member or members 30 are secured to the supporting surface prior to the countertop being secured to the supporting surface. In a further scenario, one or more of the lower support members are positioned on the supporting surface prior to the countertop being positioned on the supporting surface. This scenario is usually performed if one side or end of the countertop is going to abut a wall or the like. In this description, it is assumed that the countertop is first positioned on the support surface and secured thereto. After the countertop 10 has been positioned on the upper end of the cabinet 26 and secured thereto, the lower support member 30 is positioned adjacent one of the edges of the countertop 10 with the lower wall member 36 resting on the upper end 24 of cabinet 26 (FIG. 4). If the lower wall member 36 has the lip 42 thereon, the lower support member 30 will be moved inwardly with respect to the countertop 10 until the lip 42 abuts against the edge of the countertop 10, as seen in FIG. 4. If the lower wall member 36 does not have the lip 42 thereon, the lower support member 30 will be moved inwardly with respect to the countertop until the inner end 38 of lower wall member 36 abuts against the edge of the countertop 10. In some cases, the inner end 38 of wall 36 may be partially slipped beneath the edge of the countertop 10. The lower support member 30 is secured to the countertop 10 by any convenient means.

The upper support member 50 is then attached to the lower support member 30 by inserting the wall 62 downwardly into the slot 46. When the upper support member 50 has been attached to the lower support member 30, the inner end 54 of upper wall 52 of upper support member 50 will be positioned on the upper surface 12 of the edge of the countertop, as seen in FIG. 4. The engagement of the inner end 54 with the countertop 10 not only stabilizes the light bar 28 but also shields or hides the joint between the light bar 28 and the edge of the countertop 10. The upper wall 52 of upper support member 50 also hides the lights of the light strip 64 somewhat from view.

When the light strip 64 is illuminated, the LED lights of the light strip 64 direct light into the countertop from the edge thereof to illuminate the countertop. If the light strip 64 should fail, the light strip 64 is easily replaced by simply detaching the upper support member 50 from the lower support member 30 to provide convenient access to the light strip 64 without disturbing or moving the countertop itself. The light strip 64 may be hardwired to a source of 15-volt power or secured to an electrical outlet as will be described hereinafter.

Figure 8:
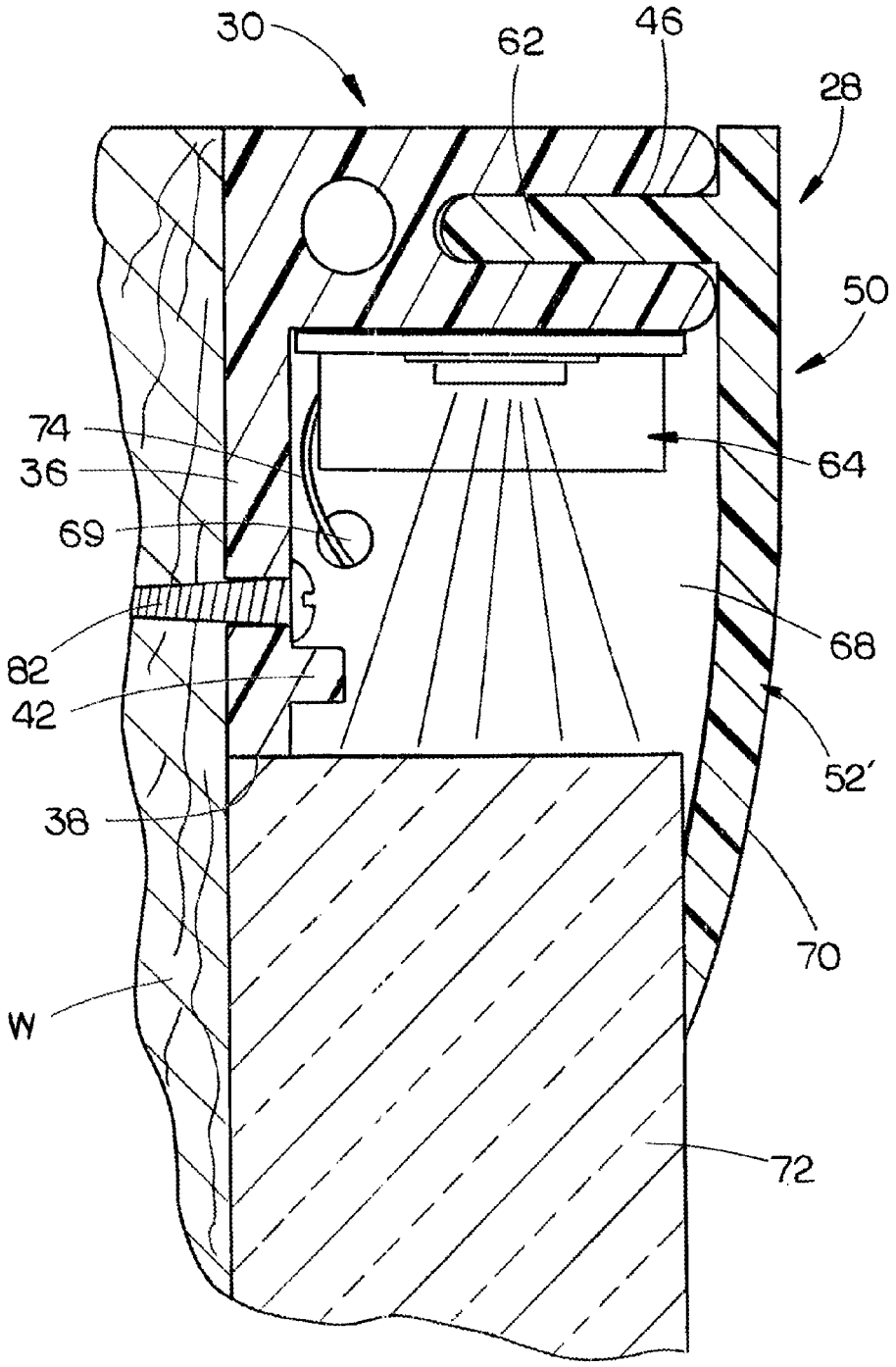
FIG. 8 is a partial sectional view illustrating the light bar of this invention being positioned adjacent an edge of a glass backsplash to illuminate the same.
Figure 9:
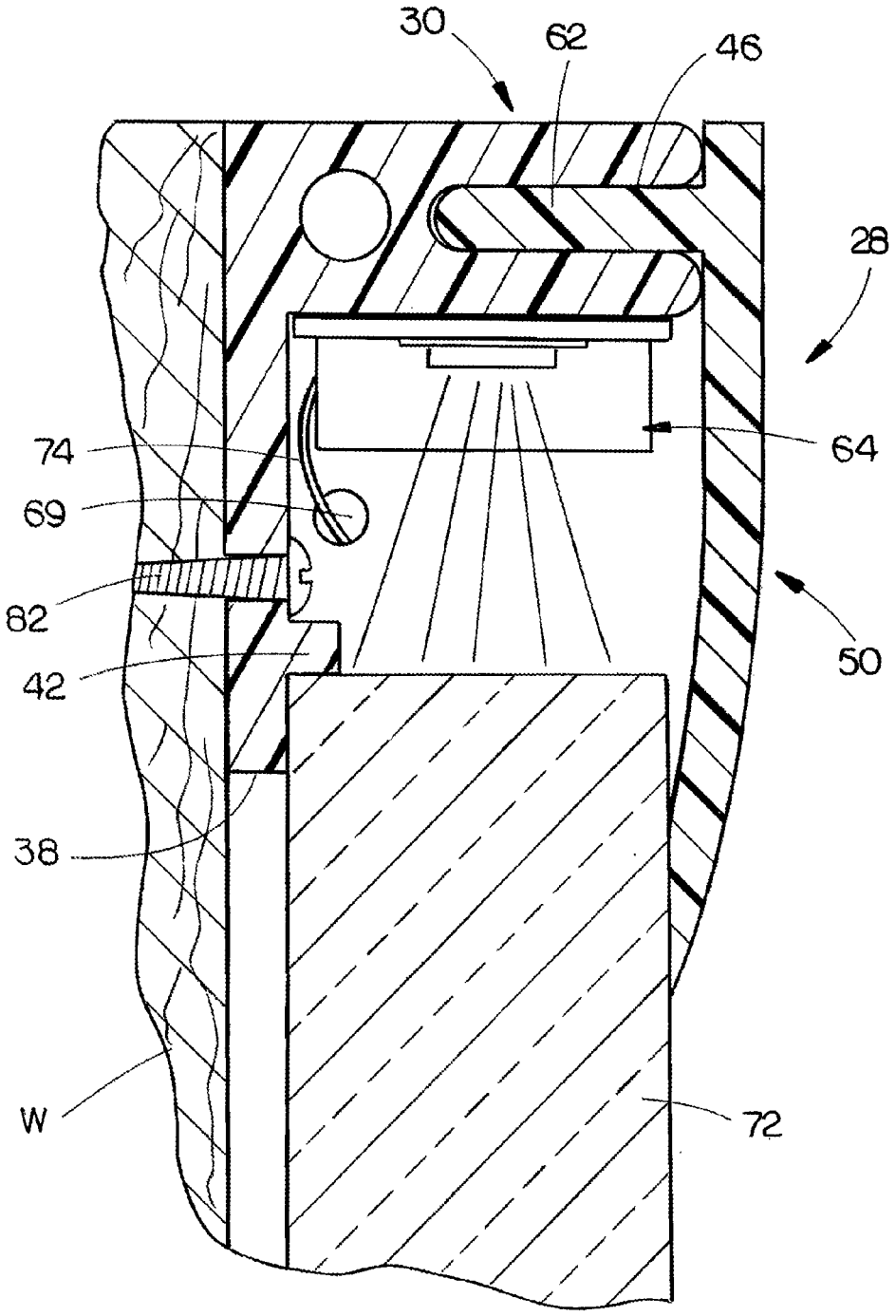
FIG. 9 is a sectional view of one embodiment of the invention.

If desired, a light bar 28 may be installed at all the edges of the countertop 10 or at some of the edges of the countertop, as seen in FIG. 1. If the light bars 28 are installed, as seen in FIG. 1, the end caps 66 and 68 will not be needed. In that case, the ends of the adjoining light bars 28 will be mitered or abutted. Although the light bar 28 has been shown as being used with a horizontally disposed countertop 10, the light bar or bars 28 could be used with a vertically disposed glass backsplash 72, as seen in FIG. 8. The light strip or strips 64, when energized, direct light into the countertop 10 or backsplash, to illuminate the same. FIGS. 5-8 illustrate a slightly modified form of the upper wall of the upper support member which is designated by the reference numeral 52'. The upper wall 52' does not have the tapered open surface 60 but has a downwardly and inwardly extending wall 70 formed therein. When the light bar 28, having the wall 70 thereon, is utilized, the inner end of the wall 70 will slightly overlap the edge of the countertop 10 or the backsplash 72. In either case, the end caps 66 and 68, if used, will have a slightly different shape. FIG. 9 illustrates a slightly different way of attaching the light bar 28 to a backsplash 72. As seen in FIG. 9, the support member 30 is secured to a wall W by screws 82 in the same manner as illustrated in FIG. 8. As also seen in FIG. 9, the lip 42 rests on the upper end of the backsplash 72. The end 38 of support member 30 is positioned between the wall W and backsplash 72 which tends to stabilize the connection therebetween.

The light bar 64 may be hardwired to a source of electrical power by electric wires 74 or have an electrical cord 78 extending therefrom to an electrical outlet. In both cases, the source of 120 volt power will be transformed into a source of 15-volt power or to a source of 12-24 volt power by a transformer 80.

Figure 10:
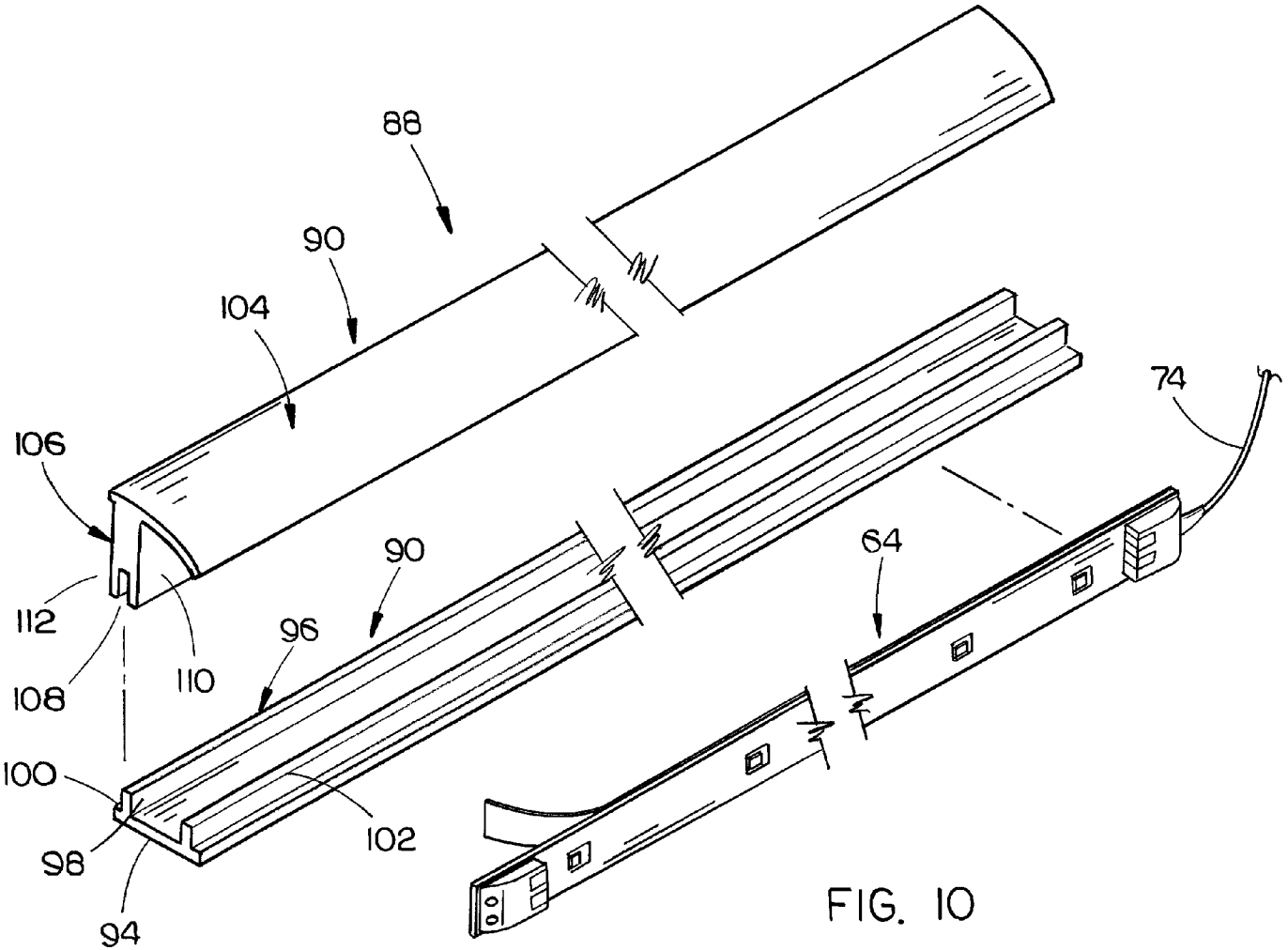
FIG. 10 is a partial sectional view of another embodiment of the lower and upper support members.

FIG. 10 illustrates a slightly modified form of the light bar which is designated by the reference numeral 88 which includes a lower support member 90 and an upper support member 92. Lower support member 90 includes a lower wall 94. A wall 96 extends upwardly from lower wall 94 and does not have a slot formed therein such as the slot 46 seen in FIG. 6. Wall 96 will be described as having an inner surface 98 and an outer surface 100. An optional lip 102 extends upwardly from lower wall 94, as seen in FIG. 10.

Figure 3:
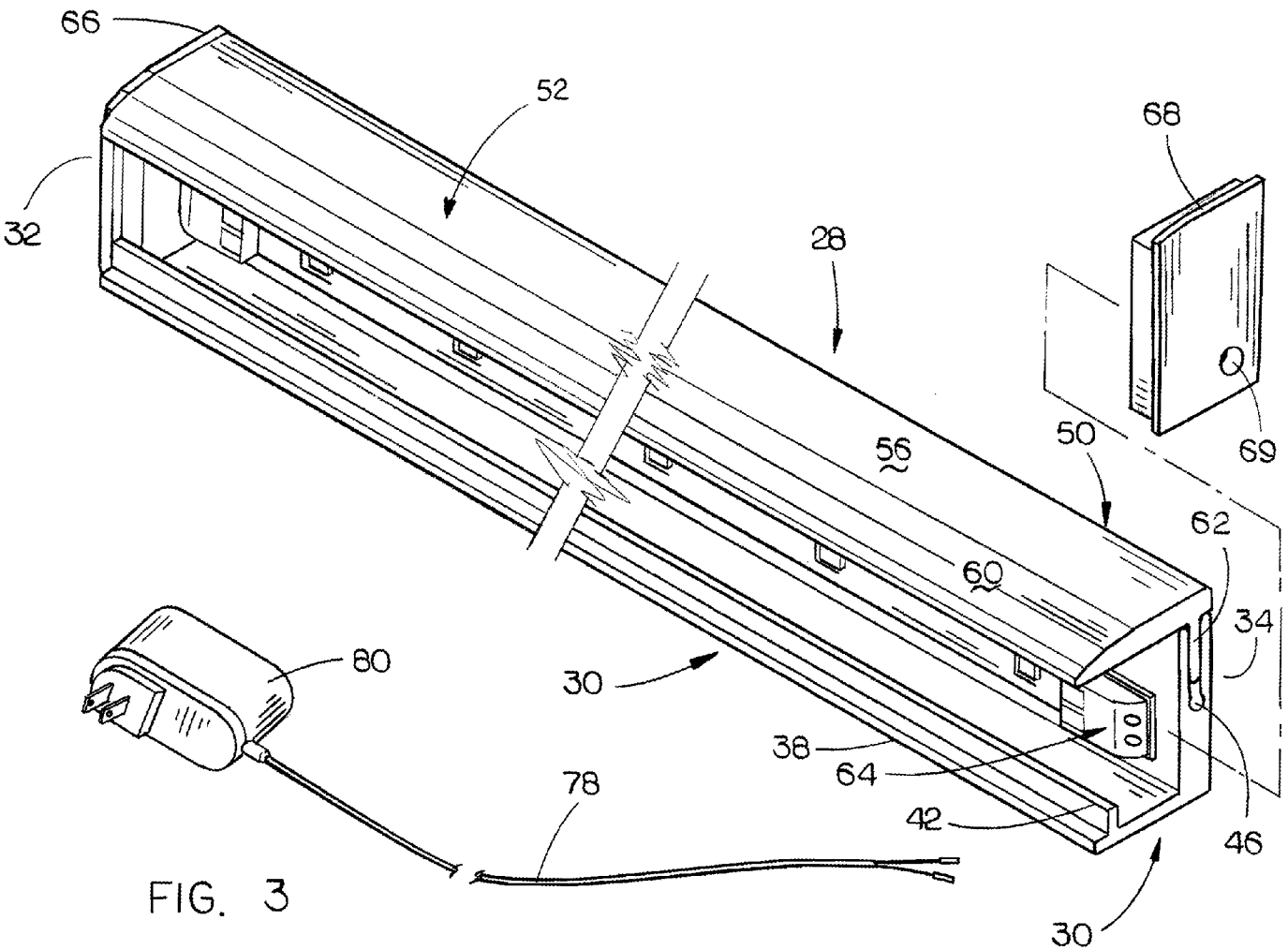
FIG. 3 is a partial exploded perspective view of the embodiment of FIG. 2 wherein the upper support member is secured to the lower support member thereof.
Figure 6:
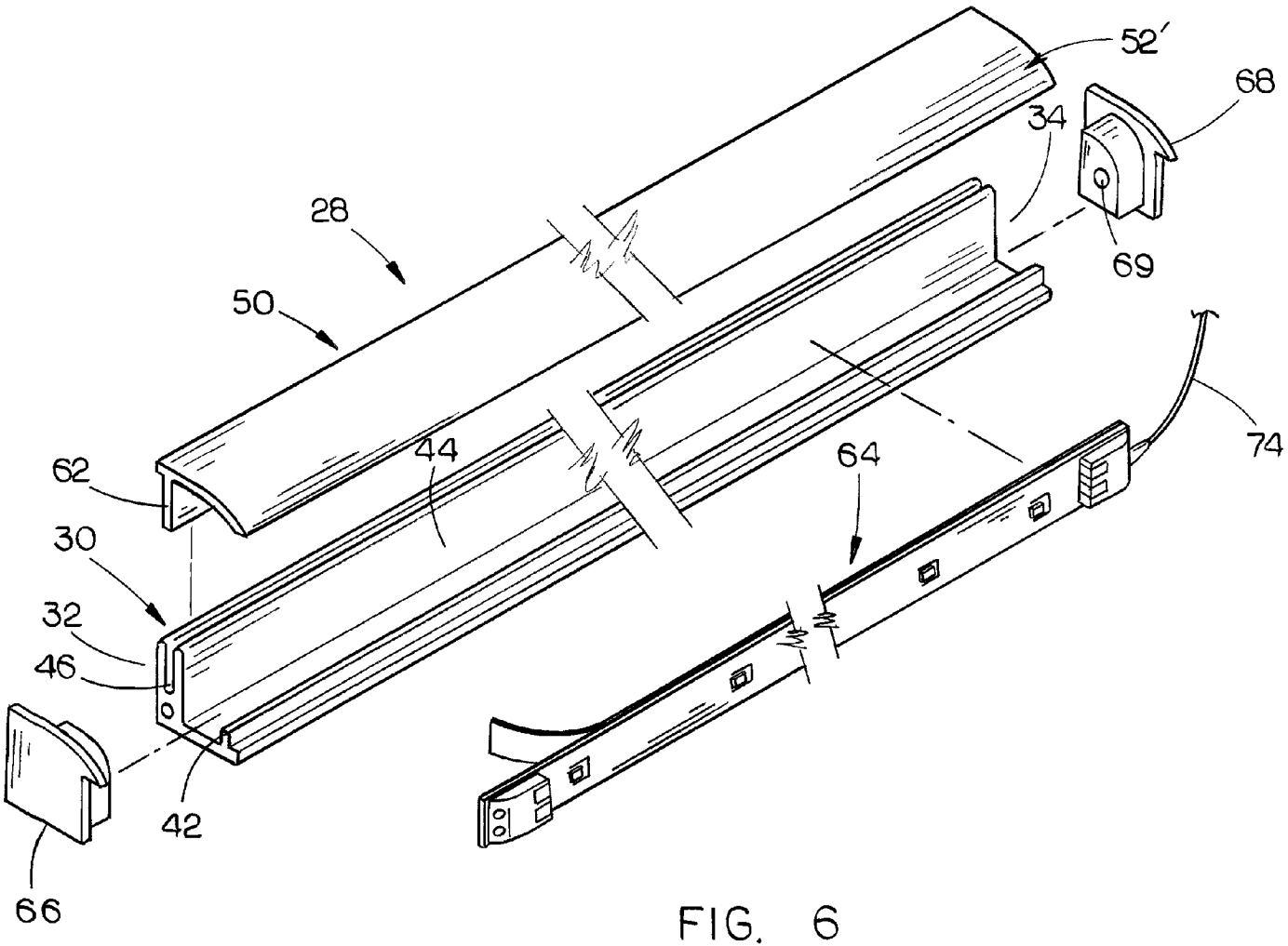
FIG. 6 is a partial perspective view of the second embodiment of FIG. 5 wherein the upper support member is secured to the lower support member thereof.
Figure 7:
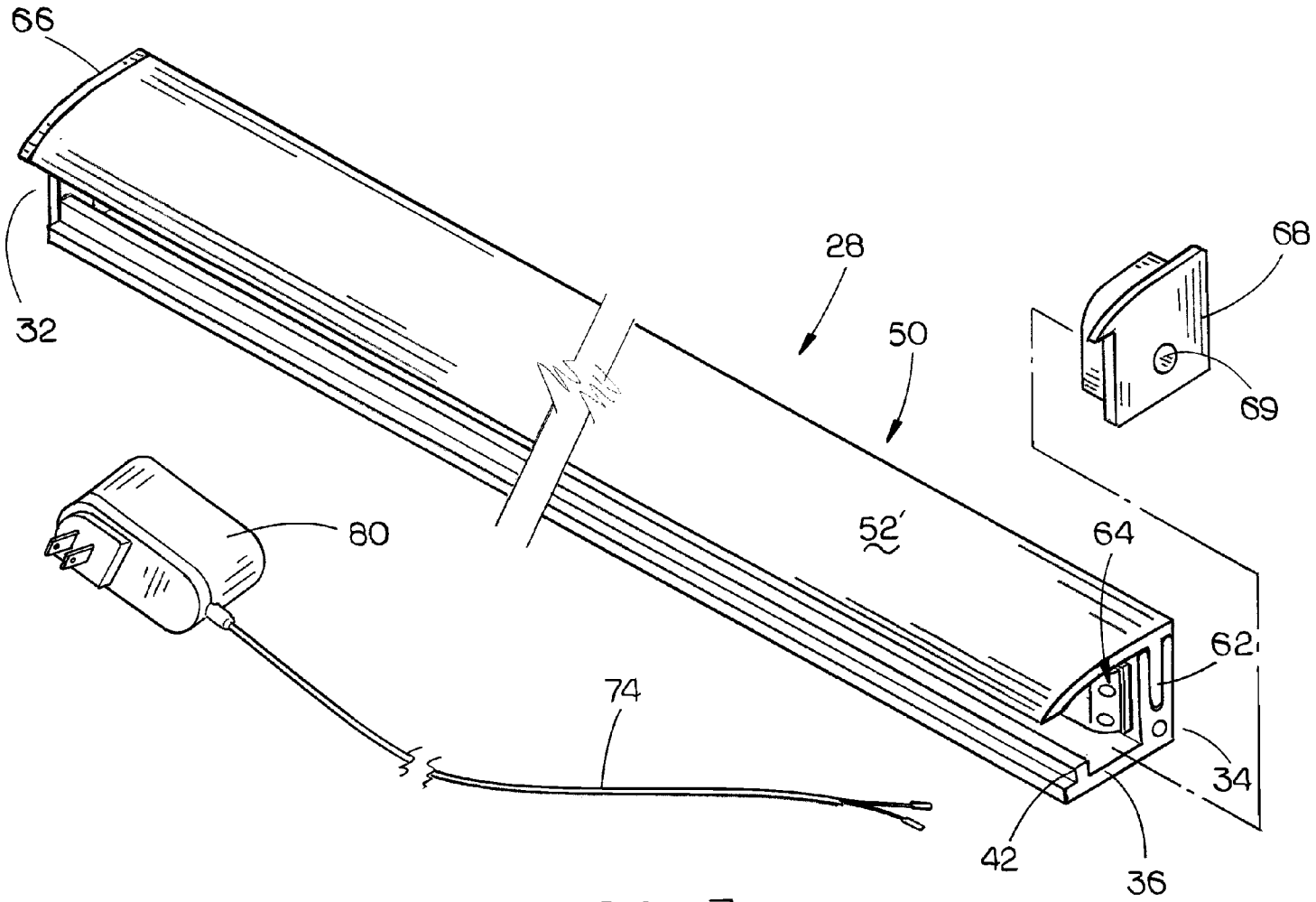
FIG. 7 is a partial sectional view of the second embodiment of the light bar of this invention wherein the upper support member is secured to the lower support member thereof.

Upper support member 90 has an upper or top wall 104 which may be configured such as top wall 52 in FIG. 3 or top wall 52', as seen in FIG. 6. A wall 106 extends downwardly from top wall 104 and has a slot 108 extending into the lower end thereof. Wall 106 will be described as having an inner side 110 and an outer side 112.

The upper support member 92 is secured to the lower support member 90 by means of the wall 96 of lower support member 90 being received in the slot 108 of upper support member 92. A light strip 64 is secured to the inner side 110 of wall 106. The electrical wires 74 may extend outwardly through one of the ends of light bar 88 or through an opening formed in wall 106 of upper support member 90.

Although the invention has been described as being used with a countertop or backsplash, the invention may be used with any other piece of material such as a mirror.

Thus it can be seen that a novel invention has been provide which accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A combination structure, comprising:

a horizontally disposed glass countertop positioned on the upper end of a supporting structure and which has an upper surface, a lower surface, a first end edge, a second end edge, a first side edge and a second side edge;

an elongated, horizontally disposed light bar assembly, having first and second ends, positioned adjacent one of said end or side edges of said countertop;

said light bar assembly including an elongated and horizontally extending lower support member having first and second ends;

said light bar assembly also including an elongated and horizontally extending upper support member which is selectively removably secured to said lower support member;

said lower support member having a horizontally disposed lower wall with inner and outer ends, an upstanding wall, having inner and outer sides and upper and lower ends, which extends upwardly from said outer end of said lower wall thereof, and a vertically disposed slot extending downwardly into said upstanding wall from said upper end thereof;

an elongated LED light strip secured to said inner side of said upstanding wall of said lower support member;

said LED light strip being selectively electrically connected to a source of electrical power;

said upper support member including a horizontally disposed upper wall having inner and outer ends, a vertically disposed wall, having upper and lower ends, extending downwardly from said upper wall of said upper support member adjacent said outer end of said upper wall of said upper support member;

said vertically disposed wall of said upper support member being selectively received in said slot in said upstanding wall of said lower support member to attach said upper support member to said lower support member;

said inner end of said lower support member being positioned adjacent one edge of said countertop;

said inner end of said upper wall of said upper support member being positioned above said upper surface of said countertop adjacent at one edge thereof whereby light from the LED light strip will be directed into said countertop.

2. The combination structure of claim 1 wherein a light bar assembly is positioned adjacent at a plurality of said edges of said countertop.

3. An elongated light bar assembly configured to be positioned adjacent one edge of a glass member, having inner and outer sides, for illuminated the glass member, comprising:

an elongated first support member;

an elongated second support member configured to be selectively removably secured to said first support member;

said first support member including a first wall, having first and second ends, and a second wall, having inner and outer ends and inner and outer sides, which extends transversely from said first wall of said first support member at said first end thereof;

said second wall of said first support member having a slot formed therein which extends thereinto from said outer end thereof;

an elongated LED light strip secured to said inner side of said second wall of said first support member;

said second support member including a first wall, having inner and outer ends, and a second wall, with inner and outer ends, extending transversely from said first wall thereof;

said outer end of said second wall of said second support member being selectively received in said slot in said second wall of said first support member to attach said second support member to said first support member;

said second end of said first wall of said first support member being positioned adjacent one edge of the glass member;

said outer end of said second wall of said second support member being positioned adjacent the outer side of the glass member at the edge thereof whereby light from said LED light strip will be directed into the glass member to illuminate the glass member.

4. An elongated light bar assembly configured to be positioned adjacent one edge of a member, having inner and outer sides, for illuminated the member, comprising:

an elongated first support member;

an elongated second support member configured to be selectively removably secured to said first support member;

said first support member including a first wall, having first and second ends, and a second wall, having inner and outer ends and inner and outer sides, which extends transversely from said first wall of said first support member at said first end thereof;

said second wall of said first support member having a slot formed therein which extends thereinto from said outer end thereof;

an elongated LED light strip secured to said inner side of said second wall of said first support member;

said second support member including a first wall, having inner and outer ends, and a second wall, with inner and outer ends, extending transversely from said first wall thereof;

said outer end of said second wall of said second support member being selectively received in said slot in said second wall of said first support member to attach said second support member to said first support member;

said second end of said first wall of said first support member being positioned adjacent one edge of the member;

said outer end of said second wall of said second support member being positioned adjacent the outer side of the member at the edge thereof whereby light from said LED light strip will be directed into the member to illuminate the member.

5. An elongated light bar assembly configured to be positioned adjacent one edge of a member, having inner and outer sides, for illuminated the member, comprising:

an elongated first support member;

an elongated second support member configured to be selectively removably secured to said first support member;

said first support member including a first wall, having first and second ends;

said second support member including a first wall, having inner and outer ends, and a second wall, with inner and outer ends, extending generally transversely from said first wall thereof;

said outer end of said second wall having a slot formed therein which extends thereinto;

said slot of said second wall of said second support member being selectively receiving said first wall of said first support member to attach said second support member to said first support member;

said second end of said first wall of said first support member being positioned adjacent one edge of the member;

said outer end of said second wall of said second support member being positioned adjacent the outer side of the member at the edge thereof whereby light from an LED light strip will be directed into the member to illuminate the member.

* * * * *